US005829832A

United States Patent [19]

Molee et al.

[11] Patent Number: 5,829,832

[45] Date of Patent: Nov. 3, 1998

[54] TOWEL RETAINER HEADREST DEVICE

[76] Inventors: Warren F. Molee, 30100 Town Center Dr., suite 285, Laguna Niguel, Calif. 92677-2067; Howard Ong, 26156 Sanz 'B ', Mission Viejo, Calif. 92691

[21] Appl. No.: 835,329

[22] Filed: Apr. 7, 1997

[51] Int. Cl.[6] ..... A47C 7/38

[52] U.S. Cl. ..... 297/397; 297/391; 297/220; 24/560

[58] Field of Search ..... 297/397, 391, 297/399, 401, 220, 411.23, 411.26, 411.21; 24/560; 248/345.1; 5/663

[56] References Cited

U.S. PATENT DOCUMENTS

| | | | |
|---|---|---|---|
| 490,865 | 1/1893 | Dreisbach | 297/401 |
| 5,048,892 | 9/1991 | Ledbetter | 297/397 |
| 5,123,704 | 6/1992 | Peterson | 297/391 |
| 5,273,342 | 12/1993 | Pratt | 297/399 |
| 5,503,456 | 4/1996 | Rossini | 297/397 |
| 5,611,123 | 3/1997 | Prizzi | 297/220 |

*Primary Examiner*—Peter M. Cuomo
*Assistant Examiner*—Anthony D. Barfield
*Attorney, Agent, or Firm*—Michael I. Kroll

[57] ABSTRACT

A towel retainer headrest device (10) comprising a structure (12) for supporting a head/neck of a person. A facility (14) is for securing in a removable manner the supporting structure (12) to a top tubular frame portion (16) of a lawn/beach chair (18), while holding a draped towel (20) in place on the lawn/beach chair (18). When the person sits on the towel (20) on the lawn/beach chair (18), the head/neck of the person can rest comfortably on the supporting structure (12).

6 Claims, 6 Drawing Sheets

TOWEL RETAINER HEADREST DEVICE

BACKGROUND OF THE INVENTION

1. Field of the Invention

The instant invention relates generally to holders and more specifically it relates to a towel retainer headrest device. The towel retainer headrest device will hold a towel to a lawn/beach chair, support a head/neck of a person sitting on the lawn/beach chair and provide an area thereon for advertising purposes.

2. Description of the Prior Art

Numerous holders have been provided in prior art. For example, U.S. patents numbered U.S. Pat. No. 4,105,127 to Holl; U.S. Pat. No. 4,934,540 to Novak; U.S. Pat. No. 4,993,126 to Collins and Des. 363,016 to Sipprelle, III et al. all are illustrative of such prior art. While these units may be suitable for the particular purpose to which they address, they would not be as suitable for the purposes of the present invention as heretofore described.

HOLL, FRIEDRICH

HOLDER BAR FOR SHEET-LIKE ARTICLES

U.S. Pat. No. 4,105,127

A holder bar for supporting sheet-like articles comprises an outer hollow rod having a throughgoing insertion slot extending along the length dimension of the outer hollow rod. An inner hollow rod is arranged within and supported by the outer hollow rod and is coextensive therewith. The inner hollow rod includes resiliently cooperating components to form a clamp aligned with and arranged in the zone of the insertion slot for receiving and resiliently clamping a sheet-like article introduced into the insertion slot.

NOVAK, DAVID M.

TOWEL HOLDING DEVICE

U.S. Pat. No. 4,934,540

A tubular member having a lateral opening along one side forming a longitudinal opening that is expandable outwardly to be slipped over a support member on which a towel is draped, to resiliently grip the support member and hold the towel therebetween. The tubular member may also have a flexible portion for allowing the tubular member to be bent and then fit onto a curved support.

COLLINS, JOHN W.

TOWEL HOLDERS FOR LOUNGE CHAIRS

U.S. Pat. No. 4,993,126

A holder for securing towels or other sheet-like products includes a space for receiving a strap of a lounge chair and a cavity for receiving and retaining a towel advanced longitudinally into place within the holder cavity. A protruding holding ridge at the cavity entrance prevents removal of the towel from the holder once inserted in a longitudinal direction but permits removal in a lateral direction.

SIPPRELLE, III, JAMES H.

STUMPF, JEFFREY A.

BEACH CHAIR TOWEL CLAMP

U.S. Pat. Number Des. 363,016

The ornamental design for a beach chair towel clamp, as shown and described.

FIG. 1 a perspective view of a beach chair clamp showing the new design;

SUMMARY OF THE INVENTION

Figure 1:
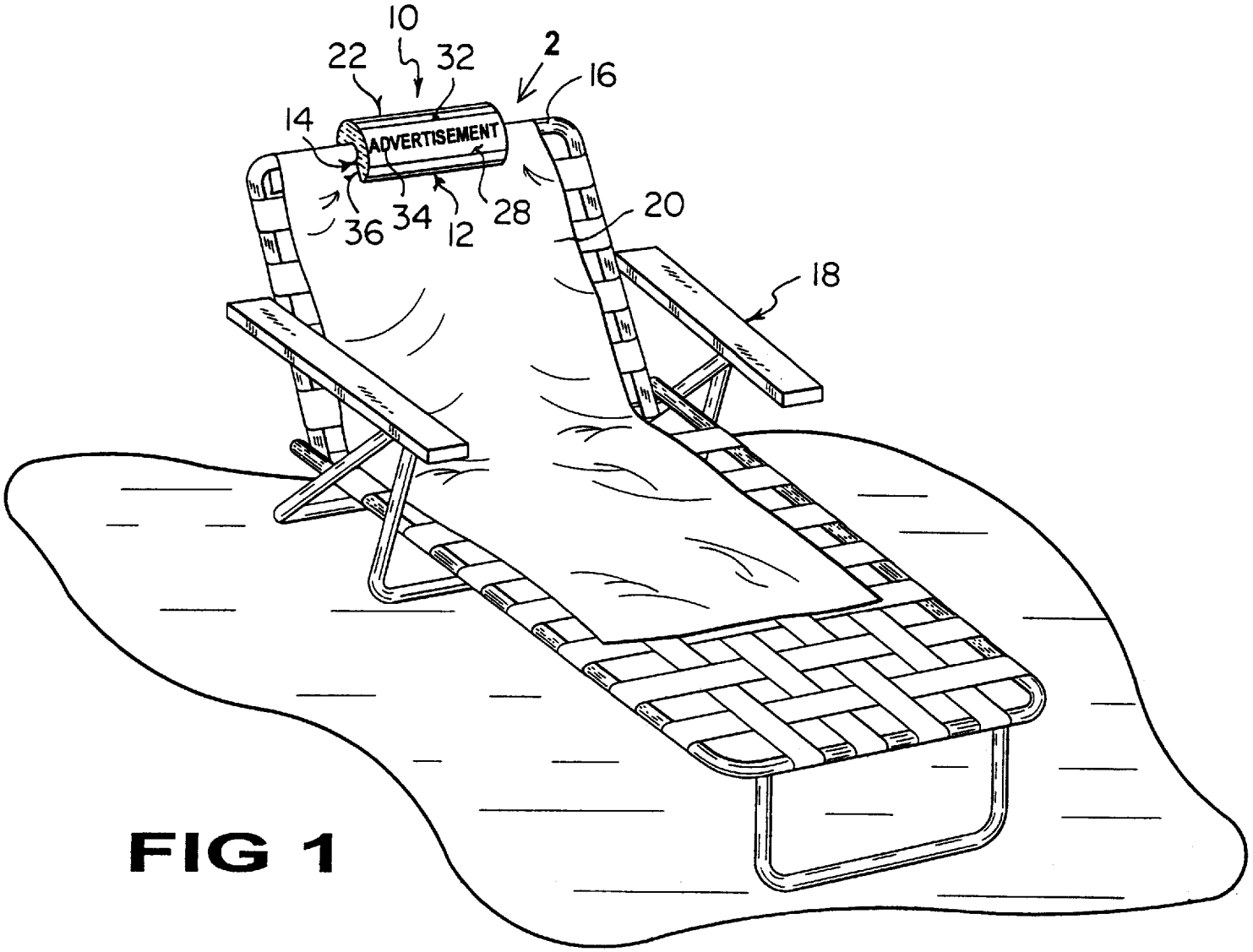

A primary object of the present invention is to provide a towel retainer headrest device that will overcome the shortcomings of the prior art devices.

Another object is to provide a towel retainer headrest device that will clip a towel over a lawn/beach chair to hold the towel in place, thereby preventing the towel from falling out of place or position on the tubular framed lawn/beach chair.

An additional object is to provide a towel retainer headrest device that will support the head/neck of a person sitting on the lawn/beach chair, while having a surface area to allow indicia to be placed thereon for advertising purposes.

A further object is to provide a towel retainer headrest device that is simple and easy to use.

A still further object is to provide a towel retainer headrest device that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

Various other objects, features and attendant advantages of the present invention will become more fully appreciated as the same becomes better understood when considered in conjunction with the accompanying drawings, in which like reference characters designate the same or similar parts throughout the several views, and wherein;

FIG. 1 is a front perspective view of a lawn/beach chair with the instant invention holding a towel in place.

Figure 2:
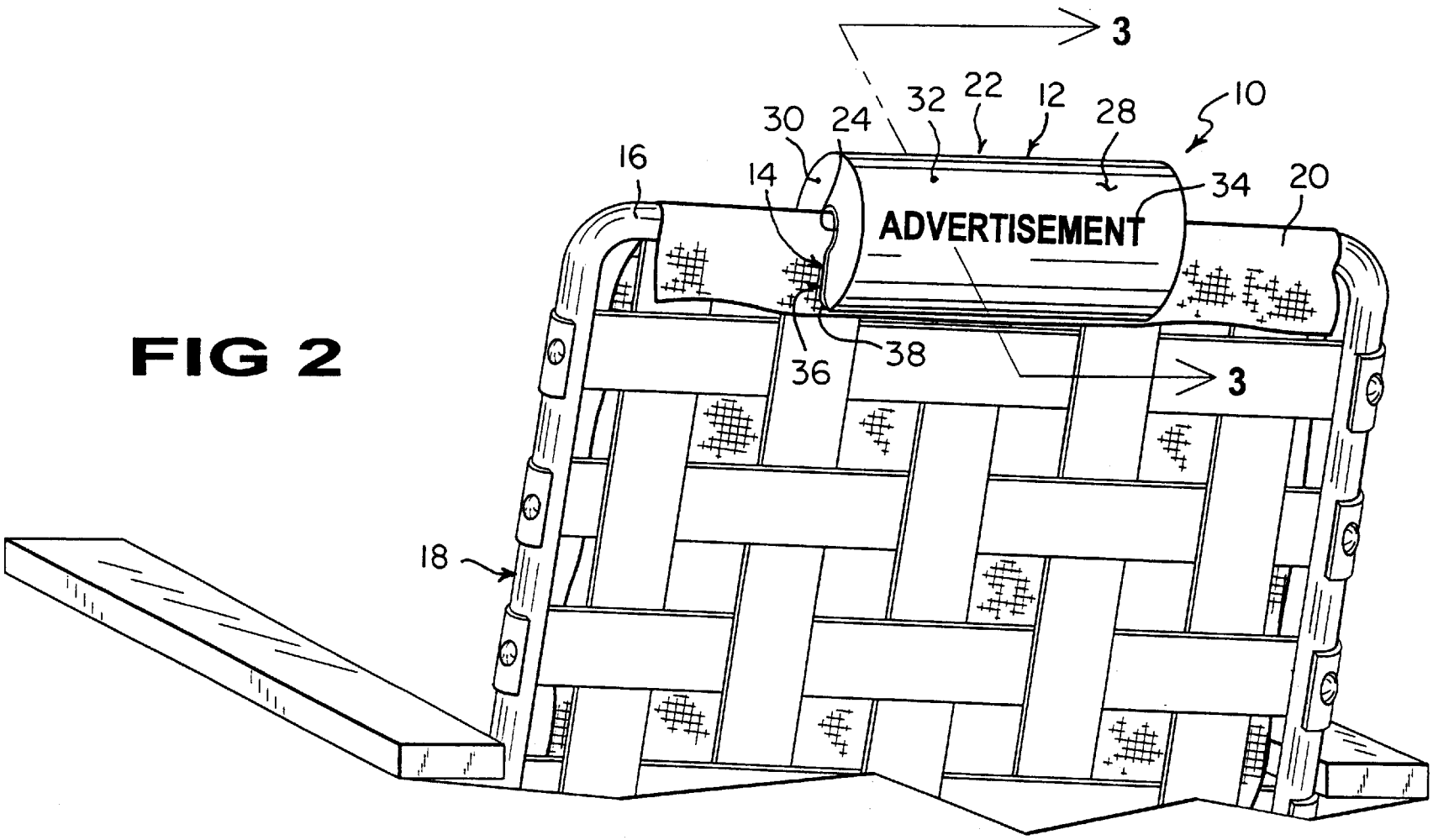
FIG. 2 is an end view thereof, the opposite end being identical.

FIG. 2 is an enlarged rear perspective view with a lower portion of the lawn/beach chair broken away.

Figure 3:
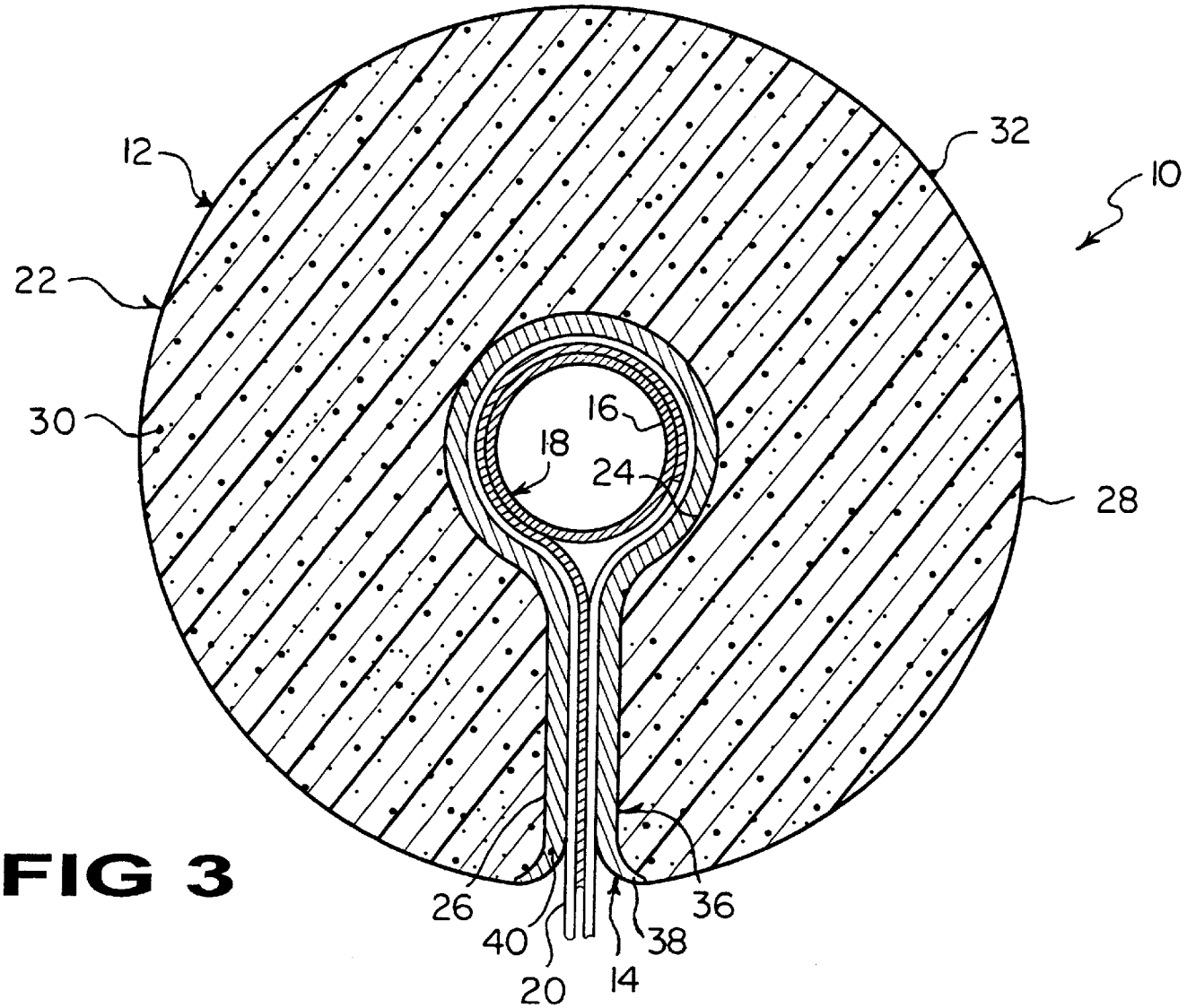
FIG. 3 is a side view thereof, the opposite end being identical.

FIG. 3 is a further enlarged cross sectional view taken along line 3—3 in FIG. 2.

Figure 4:
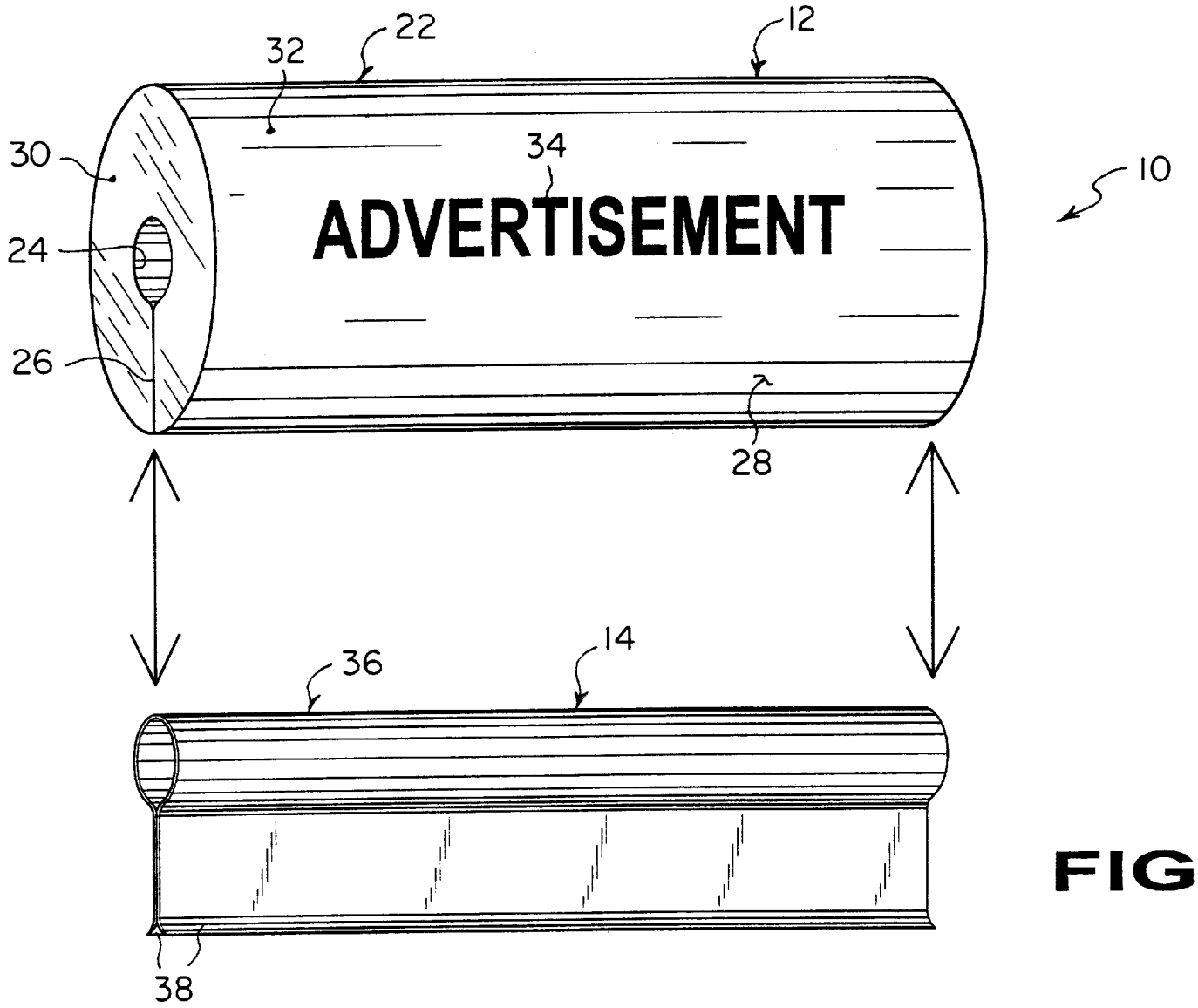
FIG. 4 is a top plan view thereof.

FIG. 4 is an exploded perspective view of the instant invention per se.

Figure 5:
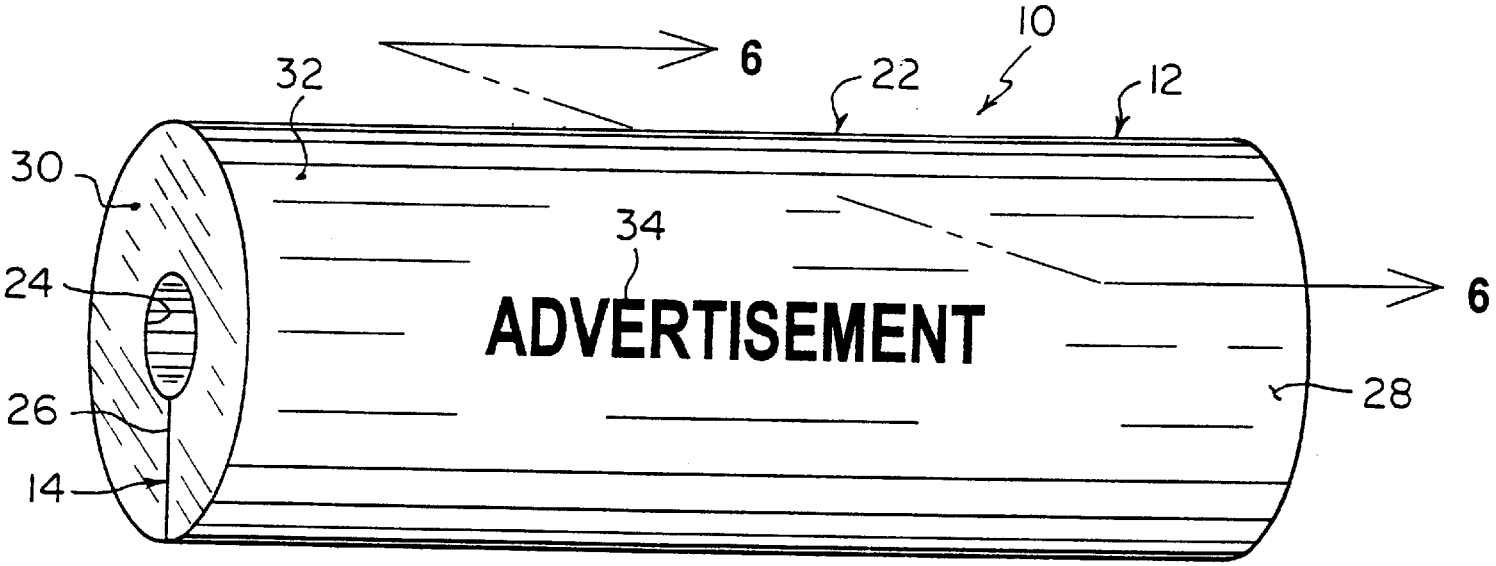
FIG. 5 is a bottom plan view thereof.

FIG. 5 is a perspective view of a first modification of the instant invention, with the insert clip eliminated.

Figure 6:
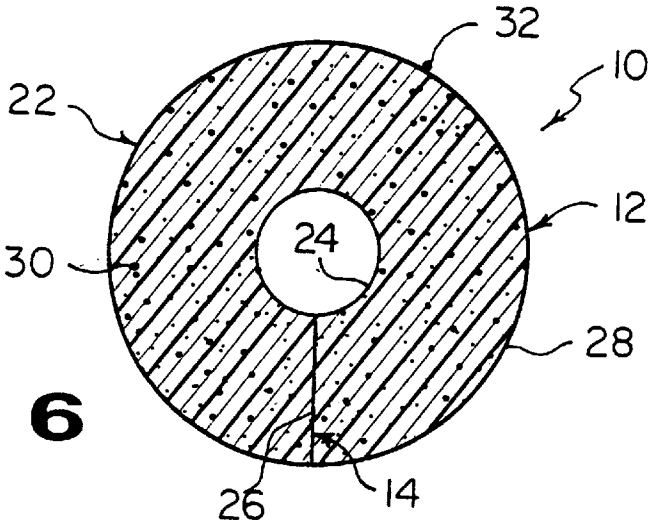

FIG. 6 is a cross sectional view taken along line 6—6 in FIG. 5.

Figure 7:
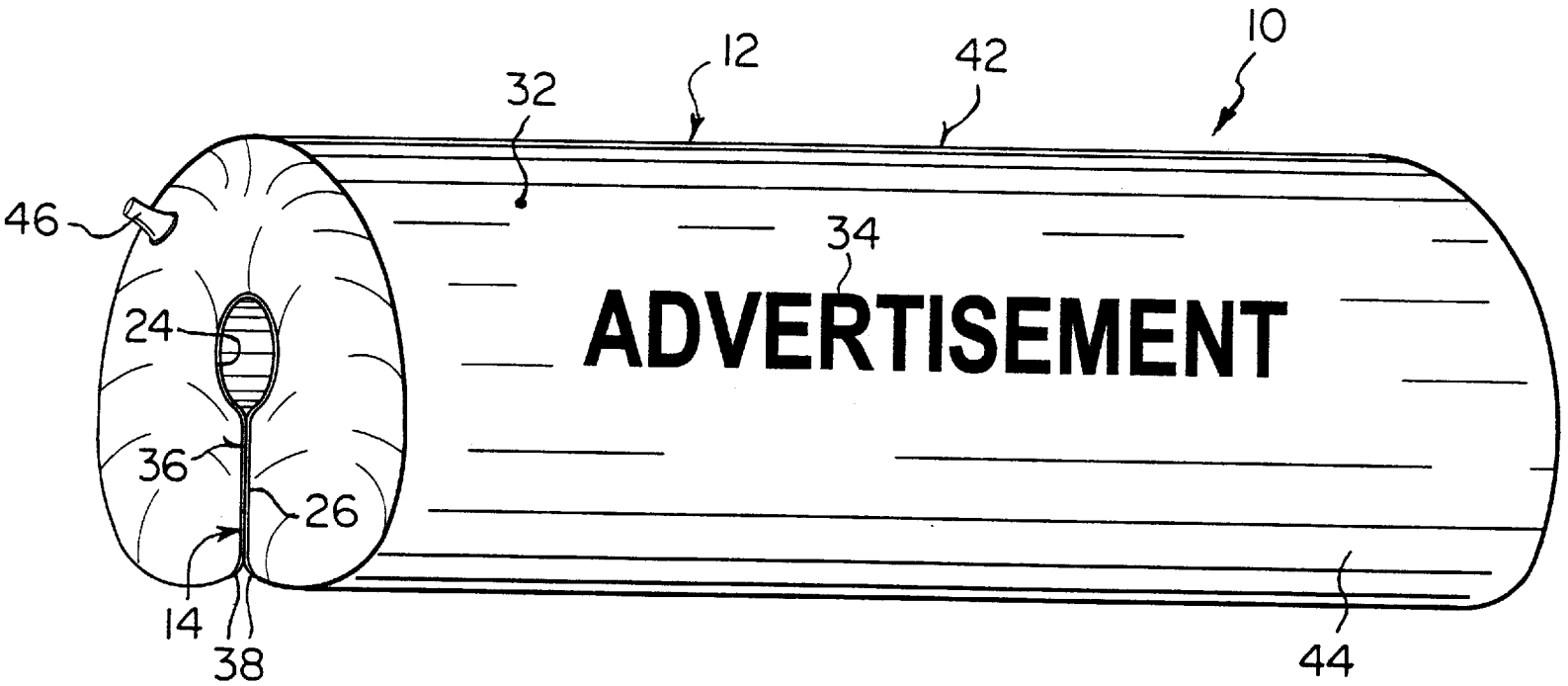

FIG. 7 is a perspective view of a second modification of the instant invention, being an inflatable cushion.

Similar reference characters denote corresponding features consistently throughout the attached drawings.

DETAILED DESCRIPTION OF THE PREFERRED EMBODIMENTS

Turning now descriptively to the drawings, in which similar reference characters denote similar elements throughout the several views, FIGS. 1 through 7 illustrate a towel retainer headrest device 10 comprising a structure 12 for supporting a head/neck of a person. A facility 14 is for securing in a removable manner the supporting structure 12 to a top tubular frame portion 16 of a lawn/beach chair 18, while holding a draped towel 20 in place on the lawn/beach chair 18. When the person sits on the towel 20 on the lawn/beach chair 18, the head/neck of the person can rest comfortably on the supporting structure 12.

As shown in FIGS. 1 through 6, the supporting structure 12 is a cylindrical cushion 22. The securing facility 14 includes the supporting structure 12 having a longitudinal aperture 24 extending therethrough and a longitudinal slit 26 extending outwardly from the longitudinal aperture 24 to an exterior surface 28. The supporting structure 12 can slip onto the top tubular frame portion 16 of the lawn/beach chair 18.

The supporting structure 12 is fabricated out of a foam material 30, with preferably a glossed skin 32 on the exterior surface 28. Indicia 34 can be placed upon the exterior surface 28 of the support structure 12 for advertising purposes.

The securing facility 14, as shown in FIGS. 1 to 4, can further include an insert clip 36 having outwardly curved flanges 38. The insert clip 36 is shaped to fit through the longitudinal slit 26 and into the longitudinal aperture 24 in the supporting structure 12 to adhere to the longitudinal aperture 24, so as to increase tension on the top tubular frame portion 16 of the lawn/beach chair 18. The insert clip 36 is fabricated out of a flexible metal material 40, which is preferably extruded plastic.

The supporting structure 12 in FIG. 7 is a cylindrical inflatable bladder 42. The cylindrical inflatable bladder 42 is fabricated out of a stretchable thin durable material 44. The cylindrical inflatable bladder 42 includes an air valve 46. Air can be forced through the air valve 46 to fill up the cylindrical inflatable bladder 42. The cylindrical inflatable bladder 42 can also be self-inflatable.

The towel retainer headrest device 10 is typically, but not limited to, to be between eight to ten inches in length and three and one half to five inches in diameter. The supporting structure 12 can be fabricated out of rubber, neoprene or other extruded foam substitutes and have a nonskinned or matte exterior surface 28. The insert clip 36 can also be fabricated out of metal, be injected molded or made from other alternate materials. The stretchable thin durable material 44 of the cylindrical inflatable bladder 42 can be fabricated out of plastic or rubber.

OPERATION OF THE INVENTION

To use the towel retainer headrest device 10, as shown in FIGS. 5 and 6, the following steps should be taken:

1. Flex the supporting structure 12, so that the longitudinal slit 26 will go into an open position.
2. Slip the longitudinal aperture 24 in the supporting structure 12 over the top tubular frame portion 16 on the lawn/bench chair 18 and the draped towel 20.
3. Release the supporting structure 12, so that the longitudinal slit 26 will go back into the closed position.

To use the towel retainer headrest device 10, as shown in FIGS. 1 through 4, the following steps should be taken:

1. Flex the insert clip 36 in the supporting structure 12, so that the longitudinal slit 26 will go into an open position.
2. Slip the insert clip 36 with the longitudinal aperture 24 in the supporting structure 12 over the top tubular frame portion 16 on the lawn/bench chair 18 and the draped towel 20.
3. Release the insert clip 36 in the supporting structure 12, so that the longitudinal slit 26 will go back into the closed position.

To use the towel retainer headrest device 10, as shown in FIG. 7, the following steps should be taken:

1. Fill up the cylindrical inflatable bladder 42 of the supporting structure 12 with forced air, through the air valve 46.
2. Flex the insert clip 36 in the supporting structure 12, so that the longitudinal slit 26 will go into an open position.
3. Slip the insert clip 36 with the longitudinal aperture 24 in the supporting structure 12 over the top tubular frame portion 16 on the lawn/bench chair 18 and the draped towel 20.
4. Release the insert clip 36 in the supporting structure 12, so that the longitudinal slit 26 will go back into the closed position.

LIST OF REFERENCE NUMBERS

10 towel retainer headrest device
12 supporting structure of 10
14 securing facility of 10 for 12
16 top tubular frame portion of 18
18 lawn/beach chair
20 towel on 18
22 cylindrical cushion for 12
24 longitudinal aperture in 12
26 longitudinal slit in 12
28 exterior surface of 12
30 foam material for 12
32 glossed skin on 28
34 indicia on 28
36 insert clip of 14
38 outwardly curved flange on 36
40 flexible durable material for 36
42 cylindrical inflatable bladder for 12
44 stretchable thin durable material for 42
46 air valve on 42

It will be understood that each of the elements described above, or two or more together may also find a useful application in other types of methods differing from the type described above.

While certain novel features of this invention have been shown and described are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by letters patent is set forth in the appended claims:

1. A combination towel retainer and headrest comprising:

a) a lawn/beach chair having a top, horizontally extending member and a towel draped over said member and extending along said chair;

b) means mounted on said chair for holding said towel in place and providing support for the head and neck of a user comprising a single piece cylindrical cushion having a longitudinal aperture extending therethrough and an extended longitudinal slit extending outwardly from said aperture to an exterior surface, said cushion being mounted on said chair member with said aperture enclosing said member and towel draped thereon, said slit enclosing a portion of said chair and towel extending from said chair member; and c) means for providing tension on said towel and chair to hold said towel in place comprising an insert clip having a shape which corresponds to and lines said longitudinal aperture and slit and having outwardly curved flanges.

2. The combination towel and headrest of claim 1 in which said cushion is fabricated out of a foam material.

3. The combination towel and headrest of claim 1 having means to accommodate indicia placed upon an exterior surface of said cushion for advertising purposes.

4. The combination towel and headrest of claim 1 in which said insert clip is fabricated out of a flexible durable material.

5. The combination towel and headrest of claim 1 in which said cushion is a cylindrical inflatable bladder.

6. The method of retaining a towel on a lawn/beach chair and supporting the head and neck of a user, said chair having a top, horizontally extending member, comprising the steps of:

a) draping a towel over said member;

a) mounting a headrest on said member for enclosing and holding said towel on said member, said headrest comprising a single piece cylindrical cushion having a longitudinal aperture extending therethrough and an extended longitudinal slit extending outwardly from said aperture to an exterior surface, said cushion being mounted on said chair member with said aperture enclosing said member and said slit enclosing a portion of said chair extending from said chair member; and c) applying tension to said towel and chair to hold said towel in place by inserting a clip having a shape corresponding to said aperture and slit into said longitudinal aperture and slit, said clip having outwardly curved flanges.

* * * * *